US007663499B2

(12) United States Patent
Min

(10) Patent No.: US 7,663,499 B2
(45) Date of Patent: Feb. 16, 2010

(54) WARNING INFORMATION DISPLAYING APPARATUS AND METHOD OF ELECTRIC DEVICE

(75) Inventor: Ju-Young Min, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 11/558,008

(22) Filed: Nov. 9, 2006

(65) Prior Publication Data

US 2007/0146156 A1 Jun. 28, 2007

(30) Foreign Application Priority Data

Dec. 27, 2005 (KR) ..... 10-2005-0130688

(51) Int. Cl.
*G08B 3/00* (2006.01)

(52) U.S. Cl. ..... 340/691.6; 340/539.1; 340/692

(58) Field of Classification Search ..... 340/540, 340/585, 539.1, 692, 691.6; 455/404.1; 379/41, 379/51; 725/33
See application file for complete search history.

(56) References Cited

U.S. PATENT DOCUMENTS

2003/0069002 A1* 4/2003 Hunter et al. ..... 455/404.1
2005/0237183 A1* 10/2005 Lamb ..... 340/539.11
2006/0273895 A1* 12/2006 Kollin ..... 340/539.17

FOREIGN PATENT DOCUMENTS

KR 1997-0055334 7/1997
KR 2002-0056400 7/2002

* cited by examiner

*Primary Examiner*—Thomas J Mullen
(74) *Attorney, Agent, or Firm*—Fish & Richardson P.C.

(57) ABSTRACT

A warning signal included in a wireless signal received, and the warning signal is displayed in the form of a warning information message. The warning information displaying method includes receiving a wireless signal through one channel among channels including a warning broadcasting channel, changing the current channel to the warning broadcasting channel when the current channel is not the warning broadcasting channel at predetermined intervals, receiving the wireless signal through the warning broadcasting channel, reading warning information corresponding to a warning signal if the wireless signal includes the warning signal, and visibly or audibly outputting the warning information.

11 Claims, 4 Drawing Sheets

$$\frac{ZCZC}{f1} - \frac{ORG}{f2} - \frac{EEE}{f3} - \frac{PSSCCC}{f4} - \frac{PSSCCC}{f4'} + \frac{TTTT}{f5} - \frac{JJJHHMM}{f6} - \frac{LLLLLLLL}{f7}$$

WARNING INFORMATION DISPLAYING APPARATUS AND METHOD OF ELECTRIC DEVICE

TECHNICAL FIELD

The present invention relates to a warning information displaying apparatus and method of an electric device, and more particularly, to a warning information displaying apparatus and method of an electric device which receive a warning signal included in a wireless signal and display the warning signal in the form of a message.

BACKGROUND ART

In general, an electric device such as a white home appliance displays information on a current operation, information on an operation state (for example, temperature, pressure, etc.) and information on reservation.

A conventional refrigerator includes a display unit such as an LCD panel for providing information on the refrigerator and controlling the refrigerator. The display unit displays a user interface. The user interface displays a temperature inside a refrigerating chamber, a temperature inside a freezing chamber, and a service type of a dispenser (water, flake ice, etc.) in the form of numbers, characters or icons. The user interface includes an input unit (for example, buttons) for controlling the temperature inside the refrigerator and the service of the dispenser.

FIG. 1 is a structure diagram illustrating a display unit of a conventional refrigerator. Referring to FIG. 1, the display unit displays a service type of a dispenser (cube type ice, water, flake ice), a set temperature of a freezing chamber and a set temperature of a refrigerating chamber, and includes an input means at its bottom end.

The conventional electric device such as the refrigerator does not receive a warning signal included in a wireless signal and provide a warning message based on the warning signal to the user.

DISCLOSURE OF THE INVENTION

The present invention is achieved to solve the above problems. An object of the present invention is to provide a warning information displaying apparatus and method of an electric device which receive a wireless signal including a warning signal through a warning broadcasting channel and visibly or audibly display the warning information or message so that the user can easily recognize the warning.

Another object of the present invention is to provide a warning information displaying apparatus and method of an electric device which receive a wireless signal through a warning broadcasting channel at predetermined intervals and rapidly notify the warning information to the user even when the user uses another broadcasting channel.

In order to achieve the above-described objects of the invention, there is provided a warning information displaying apparatus of an electric device, including: a wireless receiving module for receiving a wireless signal including a warning signal through a warning broadcasting channel; a display means for visibly displaying warning information; a storing means for storing warning information corresponding to the warning signal; and a control means for reading the warning information corresponding to the warning signal from the storing means, and displaying the warning information through the display means, when receiving the wireless signal including the warning signal from the wireless receiving module.

Preferably, the apparatus further includes an output means for audibly outputting the warning information, and the control means audibly outputs the warning information through the output means.

Preferably, the control means generates a warning message according to the warning signal and warning information, and provides the warning message to the user through the display means or the output means.

Preferably, the apparatus includes a channel selecting means for selecting a plurality of channels, and the control means controls the wireless receiving module to receive the wireless signal of the selected channel, and audibly outputs the wireless signal through the output means.

Preferably, the control means controls the wireless receiving module to receive the wireless signal of the warning broadcasting channel at predetermined intervals.

Preferably, the control means reads a preamble field of the wireless signal and decides whether the wireless signal includes the warning signal.

In addition, there is provided a warning information displaying method of an electric device includes the steps of: receiving a wireless signal; deciding whether the wireless signal includes a warning signal; reading warning information corresponding to the warning signal according to the result of the deciding step; and visibly or audibly outputting the warning information.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

The present invention will now be described in detail on the basis of preferred embodiments and accompanying drawings. However, it is recognized that the scope of the present invention should not be limited to these embodiments and drawings but to the claims as hereinafter recited.

Figure 1:
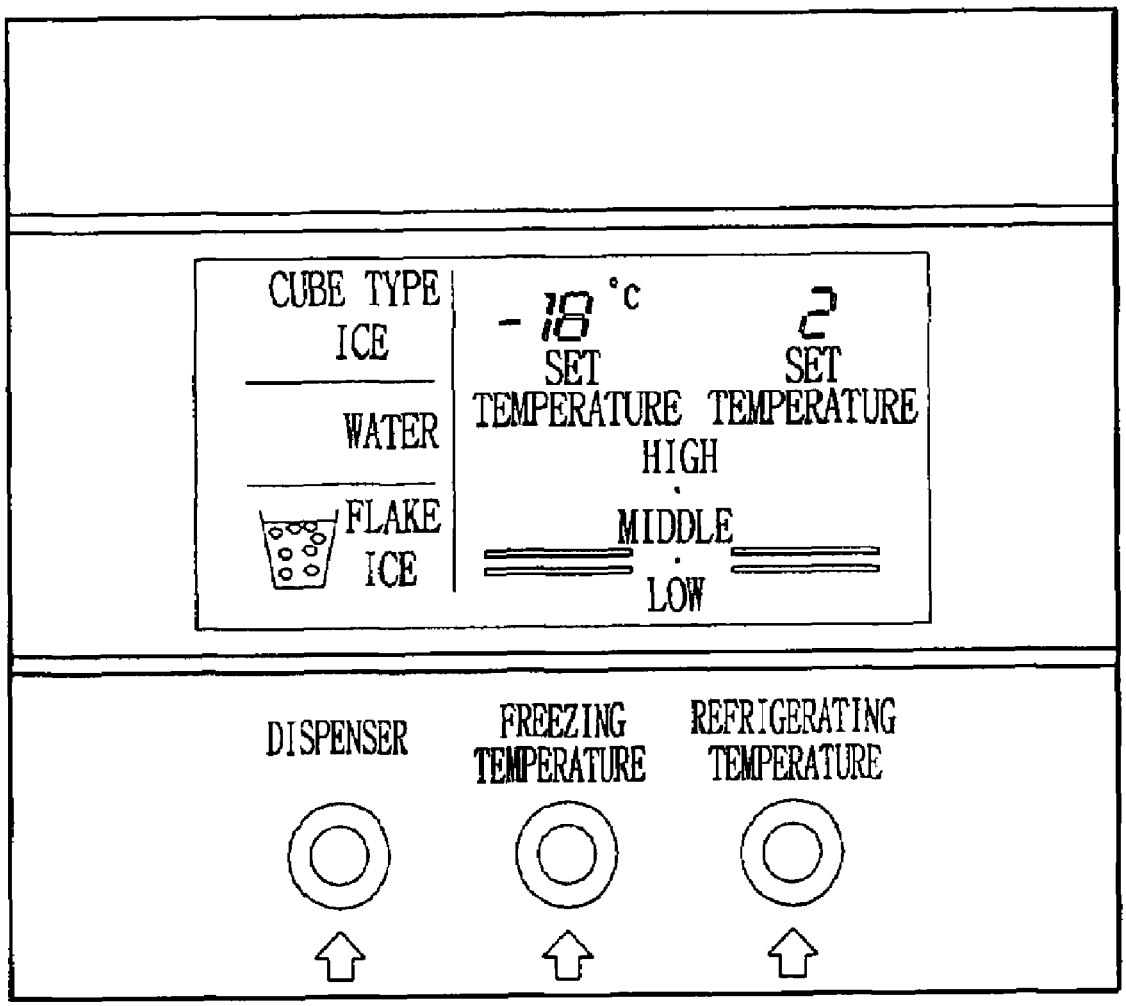
FIG. 1 is a structure diagram illustrating a display unit of a conventional refrigerator.
Figure 2:
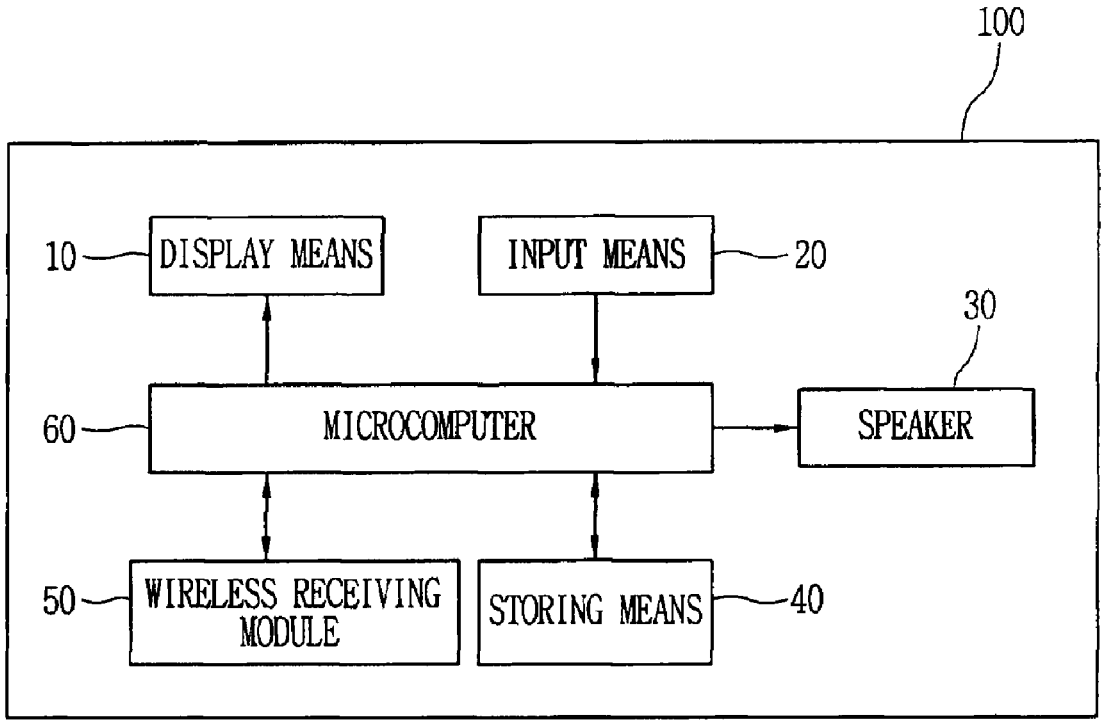
FIG. 2 is a block diagram illustrating a warning information displaying apparatus of an electric device in accordance with the present invention.

FIG. 2 is a structure diagram illustrating a warning information displaying apparatus of an electric device in accordance with the present invention.

A refrigerator will now be exemplified as the electric device.

The refrigerator 100 includes a display means 10 for displaying standby screen information (including, for example, screen background, and basic information such as a set temperature inside a freezing chamber, a set temperature inside a refrigerating chamber and a service type of a dispenser), warning information and a warning message, an input means 20 for receiving a command from the user, a speaker 30 for audibly outputting the warning information or warning message, a storing means 40 for storing the standby screen information, the warning information corresponding to the warning signal, and set information on other functions, a wireless receiving module 50 for receiving a wireless signal from an external source and demodulating the wireless signal, and a microcomputer 60 for reading and displaying the standby screen information through the display means 10, receiving the wireless signal from the wireless receiving module 50, reading the warning information corresponding to the warning signal included in the wireless signal from the storing means 40, and visibly or audibly displaying the read warning information through the display means 10 or the speaker 30. The refrigerator 100 can further include a main microcomputer (not shown) for performing freezing and refrigerating control operations. A communication line is connected between the main microcomputer and the microcomputer 60 for data communication. On the other hand, the refrigerator 100 can perform freezing and refrigerating control operations through the microcomputer 60. In addition, the refrigerator 100 includes a power supply means (not shown) for supplying power to each element.

In detail, the display means 10 is a color TFT LCD for displaying the standby screen, the warning information and the warning message. For example, the display means 10 displays an avatar (bear) and the basic information of the refrigerator as the standby screen, and further displays the warning information or warning message.

The input means 20 not only controls the general refrigerator operations but also receives background image selection (avatar) and transmits a corresponding command to the microcomputer 60. The input means 20 is formed in a button type, a touch pad type or an electrostatic type. In addition, in order to demodulate signals of a predetermined broadcasting channel among the signals received in the wireless receiving module 50, the input means 20 has a tuner unit for controlling a reception frequency according to the frequency of the broadcasting channel.

The storing means 40 stores the standby screen information and the warning information. Here, the standby screen information includes the avatar that is the background image and the basic information of the refrigerator. In the standby mode, the microcomputer 60 reads and displays the standby screen information.

Also, the storing means 40 stores the set information on the other functions. For example, the set information includes information on the set temperature inside the refrigerating chamber, the set temperature inside the freezing chamber, the service type of the dispenser, alarm setting of door opening of the refrigerator 100, setting of a power saving function (off time of the LCD window), lock setting of the input means 20, and on/off setting of a lighting device of the dispenser. The microcomputer 60 performs the control operation according to the set information.

The storing means 40 stores background image data so that the user can select an avatar or background included in the standby screen information.

In addition, the storing means 40 stores the warning information. The warning information includes at least preamble information for deciding whether the wireless signal received by the wireless receiving module 50 includes the warning signal, and header code information having information on the warning included in the warning signal.

Here, the preamble information identifies a preamble field that is the starting part of the warning signal. For example, the preamble field is comprised of 16 bytes including hexadecimal data ABAB. The preamble information has the same structure as that of the preamble field.

The header code information is information for reading header codes transmitted after or simultaneously with the preamble field. The data included in each header code are read according to positions and contents. The header code information will later be explained with reference to FIG. 3.

The wireless receiving module 50 receives the wireless signal from the air like a radio reception device. The wireless receiving module 50 demodulates the wireless signal according to a frequency corresponding to a predetermined broadcasting channel, and transmits the demodulated wireless signal to the microcomputer 60 or the speaker 30. The wireless receiving module 50 receives the broadcasting channel (or frequency) received through the input means 20 and selected by the user from the microcomputer 60, and provides the corresponding wireless signal to the microcomputer 60. The wireless receiving module 50 can be installed inside or outside the refrigerator 100.

The microcomputer 60 reads the standby screen information including the avatar selected by the user or the automatically-set (default) avatar and the basic information of the refrigerator 100 from the storing means 40, and displays the standby screen through the display means 10.

When obtaining the warning signal from the wireless receiving module 50, the microcomputer 60 reads the corresponding warning information from the storing means 40 and displays the warning information.

In the standby mode in which the user does not use the refrigerator 100 (for example, the user does not input a signal or reset the temperature inside the refrigerating chamber or the freezing chamber), the microcomputer 60 displays the above-described standby screen through the display means 10. The warning information displaying method of the electric device in accordance with the present invention will now be described in detail.

Figures 3, 4:
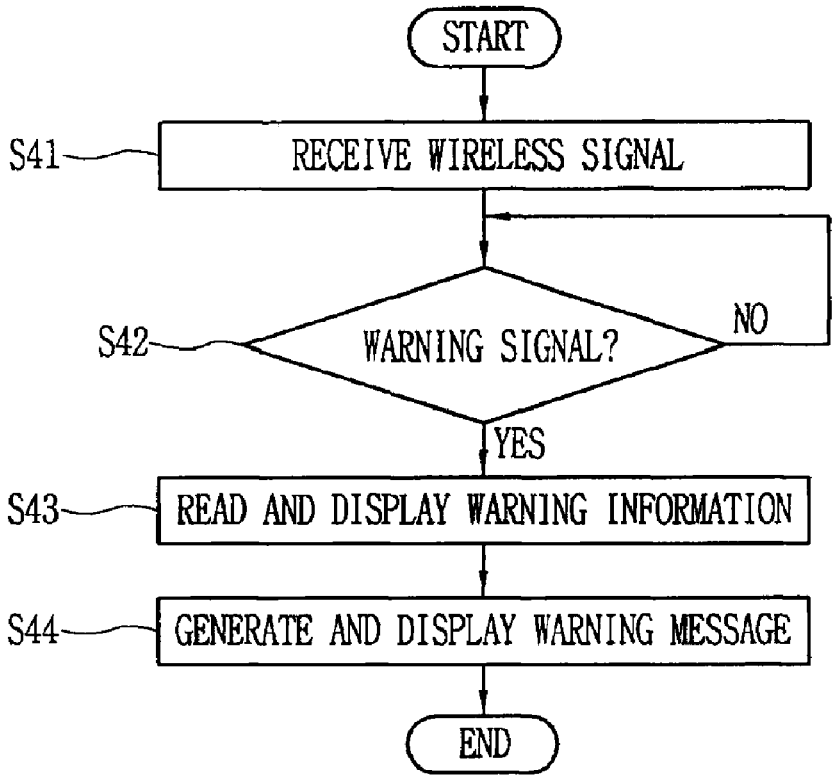
FIG. 3 shows an example of a warning signal.
FIG. 4 is a flowchart showing sequential steps of a warning information displaying method of an electric device in accordance with a first embodiment of the present invention.

FIG. 3 shows an example of the warning signal. The warning signal only shows the header code without the preamble field.

A first field f1 is an identifier for identifying start of data transmission of ASCII header code. The first field f1 includes ZCZC that are ASCII characters.

'–' distinguishes each field of the header code.

A second field f2 identifies a person or originator generating the header code. In the case of a broadcast station, EAS is included.

A third field f3 is an event header code including a kind of warning included in the warning signal. For example, dust storm warning is added as DSW and Tsunami watch is added as TSA.

A fourth field f4 is a field indicating a geographical area influenced by the warning signal. That is, the areas receiving the warning signal are classified under a predetermined standard, and codes for classification are included in the fourth field f4. For example, P indicates a nation or state, SS indicates areas in the nation or state, and CCC indicates small areas in SS. The fourth field f4 relates to the broadcasting channel for reception of the wireless signal including the warning signal. The broadcasting channel for reception of the wireless signal can be differently set according to the position in which the electric device is installed or the area which the user wants to know. As a result, the user needs to set the broadcasting channel.

A fourth field f4' means that PSSCCC can be sequentially added in each area, when a plurality of areas are influenced by the warning signal.

A fifth field f5 is a purge time header code indicating an event valid time (minute) of the third field f3 from time of a succeeding sixth field f6. For example, +0015' means 15 minutes. It is always accompanied by '+'.

The sixth field f6 is a transmission time of the warning signal. Universal Time Coordinated (UTC) is applied. For example, 1010 means 1010 UTC.

A seventh field f7 indicates an originator receiving the warning signal from the person or originator of the second field f2 and transmitting the wireless signal including the warning signal.

The warning information stored in the storing means 40 includes all data for decoding the warning signal of FIG. 3, namely, information on characters or abbreviated forms and numbers that can be included in each field f1 to f7.

FIG. 4 is a flowchart showing sequential steps of a warning information displaying method of an electric device in accordance with a first embodiment of the present invention. FIG. 4 shows the steps after the user controls the input means 20 with a frequency of a warning broadcasting channel in order to receive the wireless signal which can include the warning signal. In general, the wireless signal of the warning broadcasting channel includes weather information or other news. When it is necessary to transmit a predetermined warning signal, the warning broadcasting channel transmits the wireless signal including the previous information signal and the warning signal. The wireless receiving module 50 receives the warning signal.

In detail, in S41, the microcomputer 60 transmits a frequency for reception of the wireless receiving module 50 to the currently-set warning broadcasting channel, and receives the wireless signal.

In S42, the microcomputer 60 decides whether the received wireless signal includes the warning signal by confirming whether the wireless signal includes the preamble information. As described above, when the signal including ABAB exists, the microcomputer 60 decides that the wireless signal includes the warning signal and goes to S43. If not, the microcomputer 60 maintains the standby state. In the standby state, the current information is continuously outputted through the speaker 30. Even if the routine goes to the following steps S43 and S44, the information is continuously outputted.

In S43, the microcomputer 60 separates the wireless signal including the preamble information, namely, the warning signal, reads the warning information corresponding to each field included in the warning signal from the storing means 40, and displays the warning information through the display means 10. The microcomputer 60 displays at least the warning information corresponding to the third field f3 to the sixth field f6 through the display means 10, so that the user can prepare for the warning. In addition, the microcomputer 60 can audibly output the warning information through the speaker 30.

In S44, the microcomputer 60 combines the warning information read in S43 in the form of a sentence, and visibly displays the warning information through the display means 10 or audibly outputs the warning information through the speaker 30.

Figure 5:
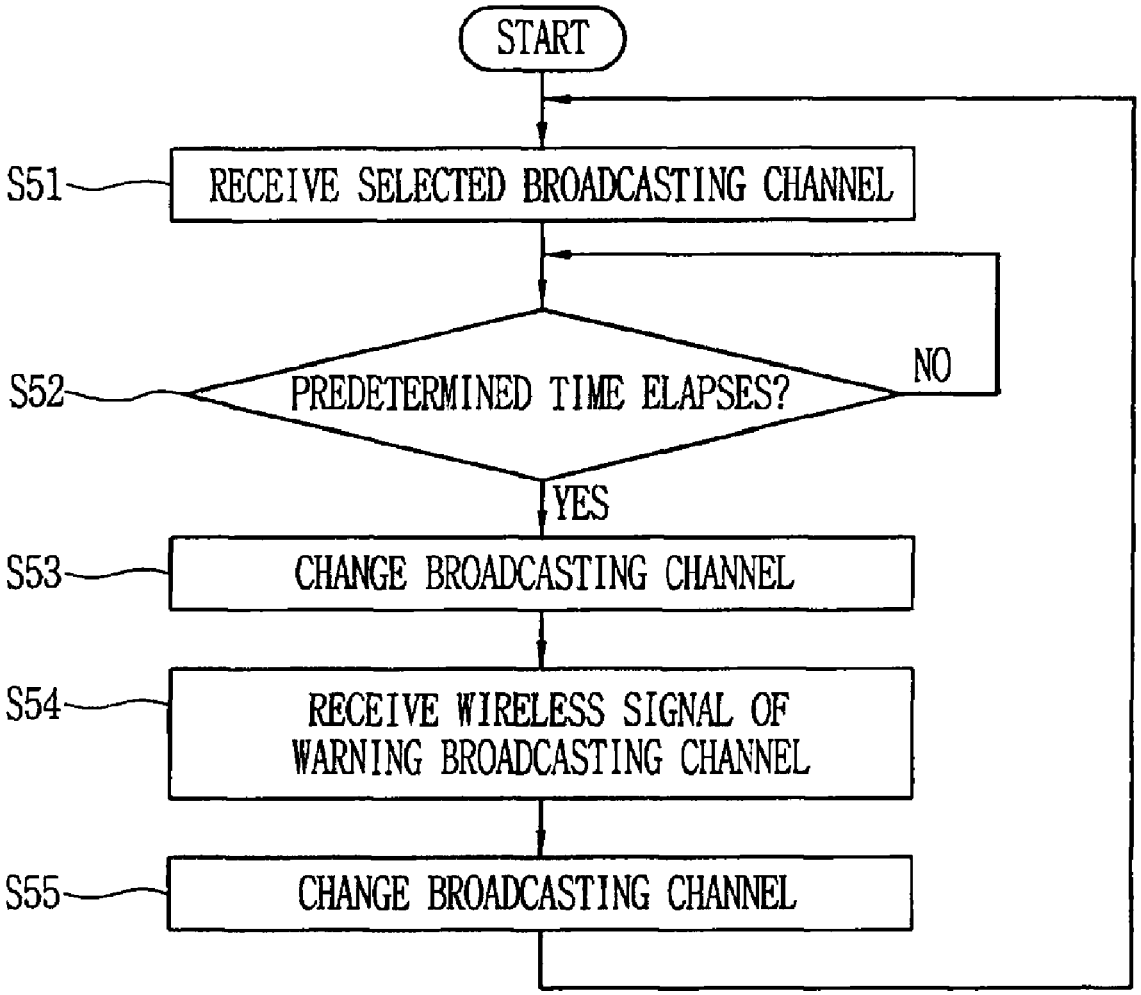
FIG. 5 is a flowchart showing sequential steps of a warning information displaying method of an electric device in accordance with a second embodiment of the present invention.

FIG. 5 is a flowchart showing sequential steps of a warning information displaying method of an electric device in accordance with a second embodiment of the present invention. FIG. 5 shows the method for receiving and displaying the warning signal when the user listens to another broadcasting channel.

In S51, the microcomputer 60 transmits a frequency of a broadcasting channel selected by the user through the input means 20 to the wireless receiving module 50, and the wireless receiving module 50 demodulates a wireless signal corresponding to the received frequency and transmits the wireless signal to the microcomputer 60, so that the wireless signal can be outputted through the speaker 30.

In S52, the microcomputer 60 maintains the standby state for a predetermined time.

In S53, the microcomputer 60 transmits the frequency of the warning broadcasting channel to the wireless receiving module 50 instead of the current frequency, thereby instantaneously changing the broadcasting channel.

In S54, the microcomputer 60 controls the wireless receiving module 50 to receive the wireless signal of the warning broadcasting channel.

In S55, the microcomputer 60 retransmits the frequency of the broadcasting channel selected by the user in S51 to the wireless receiving module 50 instead of the frequency of the warning broadcasting channel, so that the user can listen to the corresponding broadcasting.

In the above steps S53 to S55, the microcomputer 60 must perform the changing and receiving operations very fast not to be recognizable by the user.

In addition, the microcomputer 60 sequentially performs the steps S41 to S44 of FIG. 4 on the wireless signal received in S54 individually from the process of FIG. 5. When the warning signal exists, the microcomputer 60 sequentially notifies the corresponding warning information and warning message through the display means 10 or the speaker 30, so that the user can rapidly recognize the warning.

As discussed earlier, in accordance with the present invention, the warning information displaying apparatus and method of the electric device receive the wireless signal including the warning signal through the warning broadcasting channel, and visibly or audibly display the warning message so that the user can easily recognize the warning.

Moreover, the warning information displaying apparatus and method of the electric device receive the wireless signal through the warning broadcasting channel at predetermined intervals and rapidly notify the warning information to the user, even when the user uses another broadcasting channel.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A warning information displaying apparatus of an electric device, comprising:

a wireless receiving module for receiving a wireless signal;

a display means for visibly displaying warning information;

a storing means for storing warning information corresponding to a warning signal;

a channel selecting means for selecting one channel from among a plurality of channels, the plurality of channels including a warning broadcasting channel; and a control means for:

controlling the wireless receiving module to change the current channel selected by the channel selecting means to the warning broadcasting channel at predetermined intervals when the current channel selected by the channel selecting means is not the warning broadcasting channel, and to receive the wireless signal, which includes the warning signal, through, the warning broadcasting channel, reading the warning information corresponding to the warning signal from the storing means if the received wireless signal includes the warning signal, and displaying the read warning information through the display means, when receiving the wireless signal including the warning signal from the wireless receiving module.

2. The apparatus of claim 1, further comprising an output means for audibly outputting the warning information, wherein the control means audibly outputs the warning information through the output means.

3. The apparatus of claim 2, wherein the control means generates a warning message according to the warning signal and warning information, and provides the warning message to the user through the display means or the output means.

4. The apparatus of claim 1, wherein the control means reads a preamble field of the wireless signal and decides whether the wireless signal includes the warning signal.

5. A warning information displaying method of an electric device, the method comprising:

receiving a wireless signal through one channel selected from among a plurality of channels, the plurality of channels including a warning broadcasting channel;

changing a current channel to the warning broadcasting channel at predetermined intervals when the current channel is not the warning broadcasting channel;

receiving the wireless signal through the warning broadcasting channel;

reading warning information corresponding to a warning signal if the wireless signal includes the warning signal; and visibly or audibly outputting the warning information.

6. The method of claim 5, further comprising a step for generating a warning message according to the warning signal and the warning information, wherein the outputting step outputs the warning message.

7. The method of claim 5, wherein the reading comprises reading a preamble field of the wireless signal to determine whether the wireless signal includes the warning signal.

8. A warning information displaying apparatus of an electric device, comprising:

a wireless receiving module for receiving a wireless signal;

a display for visibly displaying warning information;

a storage device for storing warning information corresponding to a warning signal;

a channel selector for selecting one channel from among a plurality of channels, the plurality of channels including a warning broadcasting channel; and a controller, wherein the controller controls the wireless receiving module to change the current channel selected by the channel selector to the warning broadcasting channel at predetermined intervals when the current channel selected by the channel selector is not the warning broadcasting channel, and to receive the wireless signal, which includes the warning signal, through the warning broadcasting channel, wherein the controller reads the warning information corresponding to the warning signal from the storage device if the received wireless signal includes the warning signal, and wherein the controller displays the read warning information through the display, when receiving the wireless signal including the warning signal from the wireless receiving module.

9. The apparatus of claim 8, further comprising an output device for audibly outputting the warning information, wherein the controller audibly outputs the warning information through the output device.

10. The apparatus of claim 9, wherein the controller generates a warning message according to the warning signal and warning information, and provides the warning message to the user through the display or the output device.

11. The apparatus of claim 8, wherein the controller reads a preamble field of the wireless signal and decides whether the wireless signal includes the warning signal.

* * * * *